US006666570B2

(12) United States Patent
Canuel

(10) Patent No.: US 6,666,570 B2
(45) Date of Patent: Dec. 23, 2003

(54) ADJUSTABLE MOUNTING SYSTEM FOR A DIRECTIONAL LIGHT

(75) Inventor: Jean François Canuel, Toronto (CA)

(73) Assignee: Christie Lites Ltd., Toronto (CA)

( * ) Notice: Subject to any disclaimer, the term of this patent is extended or adjusted under 35 U.S.C. 154(b) by 0 days.

(21) Appl. No.: 09/985,717

(22) Filed: Nov. 6, 2001

(65) Prior Publication Data

US 2003/0086273 A1 May 8, 2003

(51) Int. Cl.[7] ..... F21S 8/08

(52) U.S. Cl. ..... 362/419; 362/384; 362/396; 362/427; 362/430

(58) Field of Search ..... 362/147, 153, 362/384, 419, 418, 396, 427, 430, 269, 285, 287, 371, 388

(56) References Cited

U.S. PATENT DOCUMENTS 6,428,197 B1 * 8/2002 Downing ..... 362/523

* cited by examiner

*Primary Examiner*—Sandra O'Shea
*Assistant Examiner*—John Anthony Ward
(74) *Attorney, Agent, or Firm*—Dimock Stratton Clarizio; Mark B. Eisen

(57) ABSTRACT

An adjustable mounting system and a mounting base for mounting lights at adjustable angles in order to direct the light at the intended target and compensate for changes in the center of gravity of the system as light accessories are added, removed or the light fixture itself is adjusted. The system comprises a mounting base, which has first and second pedestals and a cylindrical crosspiece disposed between the pedestals, a yoke which may be pivotably engaged to a light, and a releasable clamp fixed to the yoke which is pivotably engageable to the crosspiece of the mounting base. The mounting system thus has two pivotable engagement points, both of which may be adjusted independently in mounting a light to the base.

16 Claims, 3 Drawing Sheets

10

ADJUSTABLE MOUNTING SYSTEM FOR A DIRECTIONAL LIGHT

FIELD OF THE INVENTION

This invention relates generally to mounting systems for light fixtures, and particularly to mounting systems for directional lights.

BACKGROUND OF THE INVENTION

Concerts, shows, and other events make extensive use of spotlights and other directional lights to illuminate the stage, sets, and participants. In order to meet the lighting requirements of such events, these lights must be capable of being directed in various directions. They must also be stably mounted and are preferably easily portable. However, these functions have previously been mutually exclusive.

It is known, for example, to fix lights to yokes which in turn are suspended from crossbars suspended horizontally by means of clamps; however, these lights, while they are somewhat adjustable, are not easily portable since the crossbars and the mounting means for the crossbars are relatively large compared to the size of the light.

Furthermore, this type of mounting system only provides one means for adjusting the orientation of the light, via the clamp on the crossbar. When additional accessories are added to the lights, such as colour changers, lenses, or filters, the extra weight of these accessories causes the centre of gravity of the light to shift. Furthermore, adjustments to the focal length of a lens accessory, which can result in an extension or retraction of the accessory of several centimeters, also changes the centre of gravity of the light. A change in the centre of gravity of the light places additional stress on the clamp holding the light in the desired place, which can cause shifting of the light during use and unnecessary wear on the clamp and crossbar.

There is therefore a need for a mounting system which provides for adjustments to compensate for changes in weight and shifting of the centre of gravity of a light and/or accessories, which provides sufficient stability to resist shifting of the light during use while being easily portable, and which does not restrict the ability to adjust the direction of the light.

SUMMARY OF THE INVENTION

The invention overcomes these disadvantages by providing an adjustable mounting system for a directional light which is portable and stable, but does not restrict the ability to direct the light at a desired target.

Accordingly, the invention accomplishes this by providing a mounting base for an adjustable mounting system to which the light is articulated by a yoke having pivot points about both the base and the light. In the preferred embodiment the base comprises first and second pedestals, and a cylindrical crosspiece extending between the first and second pedestals. The invention accordingly provides an adjustable mounting system for directional lights which allows easy adjustment of the light to accommodate changes in the location of the center of gravity caused by adding or making adjustments to accessories, while keeping the orientation of the light on target.

In the preferred embodiment the light mounting system comprises the aforesaid mounting base, a yoke pivotably engaged to the light and having a releasable clamp which is pivotably engageable to the crosspiece of the mounting base.

The mounting system thus has two pivotable engagement points, each of which may be adjusted independently in mounting a light to the base. Adjustments at these pivotable engagement points thus provide for the alignment of the centre of gravity of the light, including any accessories attached to the light, generally above the mounting base, thus increasing the stability of the system without having to remove the light from the mounting system without impeding the adjustability of the direction of the light.

In the preferred embodiment flanges are provided at the bottom of at least one of the pedestals, the flanges being provided with bore holes, for use in fastening the mounting base to a fixed support, such as a truss or a platform. Also, in a preferred embodiment, the mounting base is configured such that the crosspiece is fixed between two inside faces of the pedestals.

The present invention thus provides an adjustable mounting system for a directional light, comprising a yoke having a first end for pivotably engaging the light at a first adjustable pivot, and a second end providing a releasable clamp, a base comprising a support supporting a crosspiece for fastening the clamp to the base at a second adjustable pivot, a first fixing element for fixing the first adjustable pivot, and a second fixing element for fixing the second adjustable pivot, wherein the first and second adjustable pivots are independently adjustable to adjust a direction of the light and a position of the light relative to the base.

The present invention further provides a base for mounting a directional light pivotably engaged to a yoke at a first adjustable pivot, the yoke being provided with a releasable clamp, the base comprising a support supporting a crosspiece for fastening the clamp to the base at an adjustable pivot.

BRIEF DESCRIPTION OF THE DRAWINGS

In drawings which illustrate by way of example only a preferred embodiment of the invention.

DETAILED DESCRIPTION OF THE DRAWINGS

Figure 1:
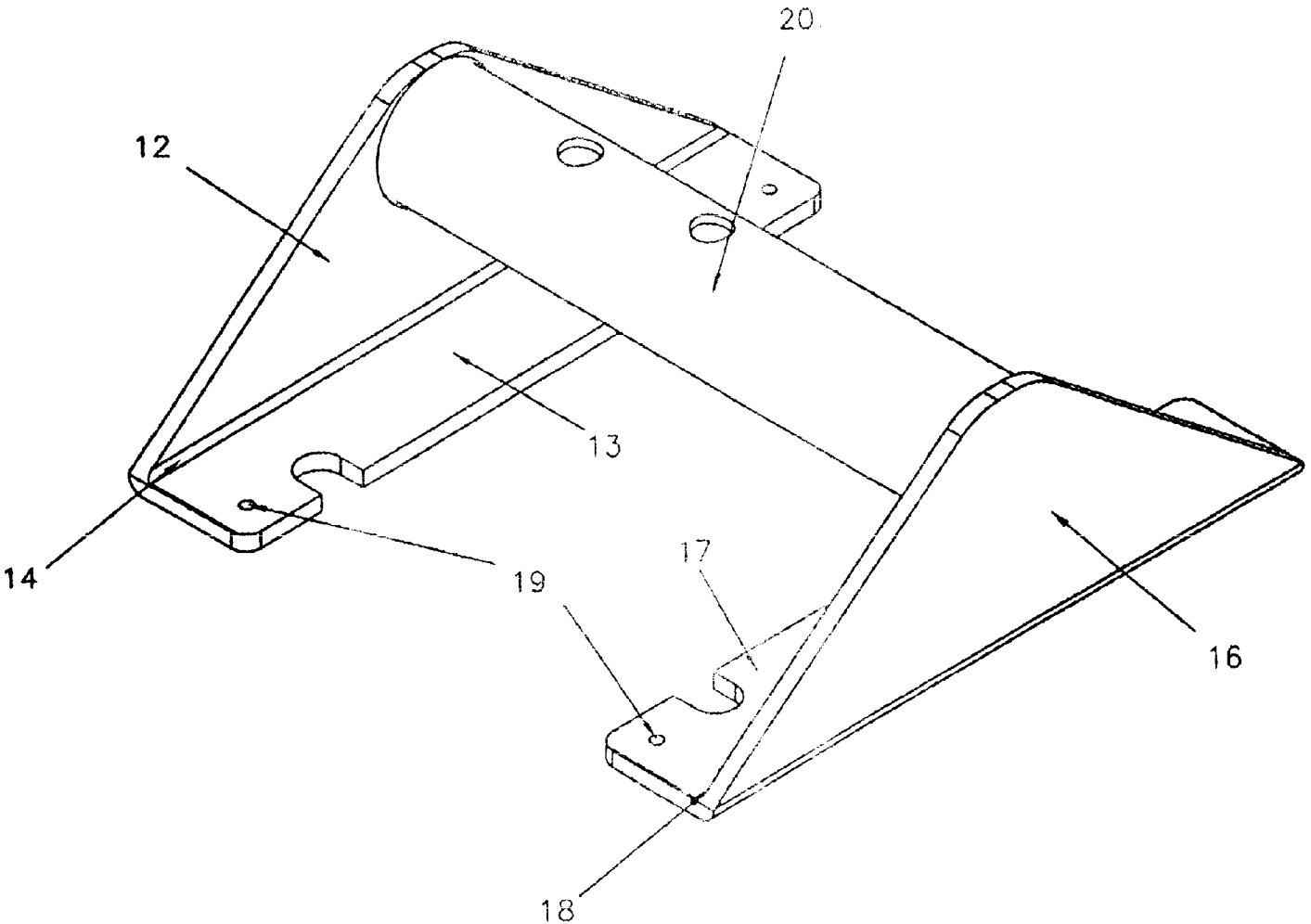
FIG. 1 is a perspective view of a preferred embodiment of the mounting base of the present invention.

Referring to FIG. 1, an embodiment of the mounting base 10 of the present invention is shown. The mounting base 10 provides supports, in the preferred embodiment comprising pedestals 12, 16 having substantially flat lower surfaces 14, 18 for resting on a level floor or platform. A cylindrical crosspiece 20 is fixed to the pedestals 12, 16 such that the crosspiece 20 is substantially parallel to the lower surfaces 14, 18, i.e. generally horizontal when in use.

In the embodiment shown in FIG. 1, the pedestals 12, 16 have a generally triangular shape with the crosspiece 20 fixed to the interior sides of the pedestals 12, 16 at the apex of the triangle. Preferably, pedestals 12, 16 are provided with flanges 13, 17 respectively which are provided with bore holes 19 for optionally fastening the mounting base 10 to a platform or truss (not shown). The mounting base 10 may be assembled from individual pieces or provided as an integral piece of cast metal, moulded plastic or any other suitable material.

Figure 2:
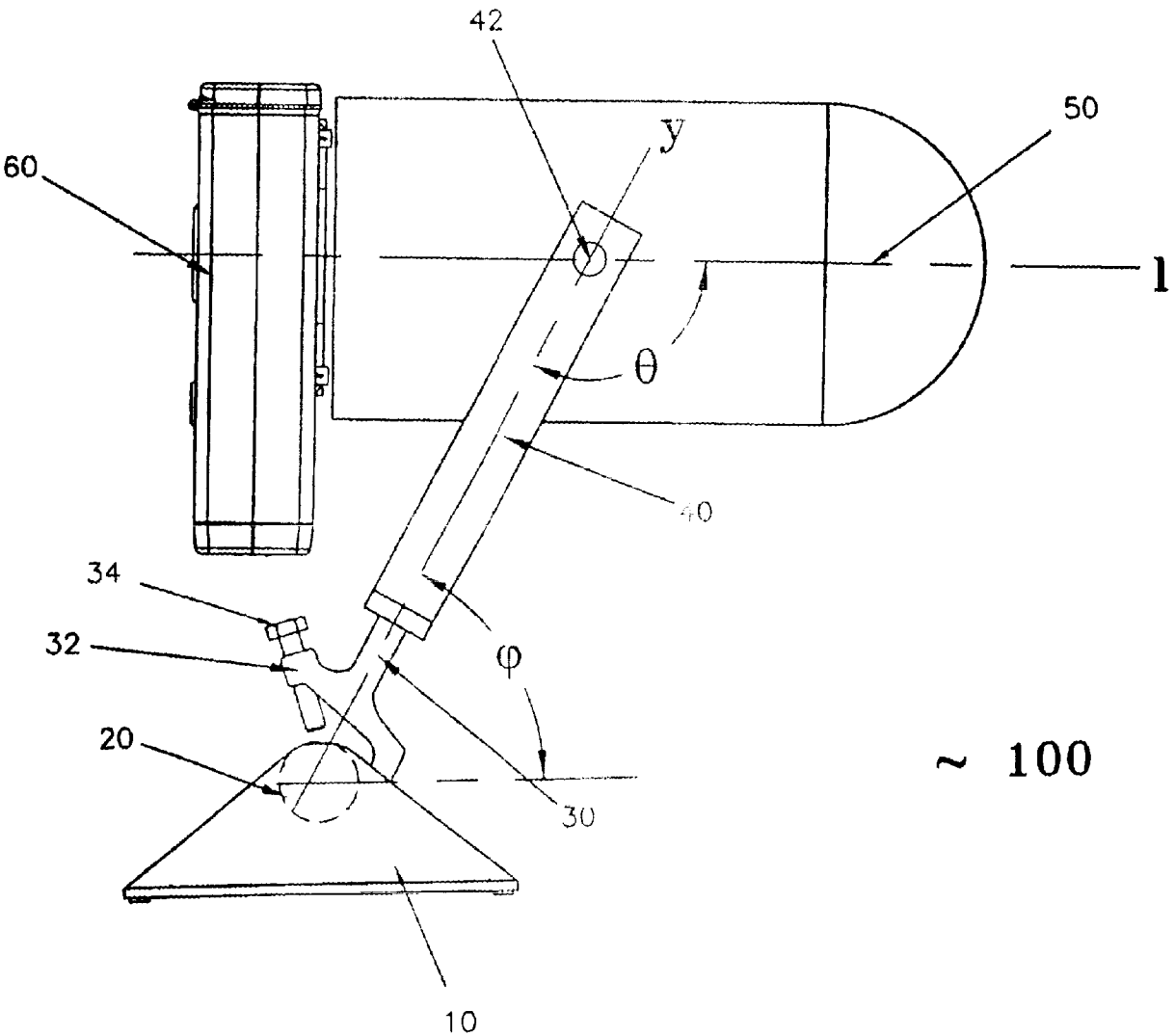
FIG. 2 is a side elevation of a preferred embodiment of the mounting system of the present invention showing an accessory mounted on a light.

An embodiment of the mounting system 100 is shown in FIG. 2. A light 50 is pivotably mounted on a yoke 40 in a configuration which is known in the relevant art. In the drawings, the cross-section of the light 50 is shown as substantially circular and having an axis l through its centre; where the light 50 has another cross-sectional configuration, the axis l is a longitudinal axis through the body of the light 50. The orientation of the light 50 with respect to the yoke 40, as indicated by the angle θ between the plane of the yoke 40 indicated as y in FIG. 2 and the longitudinal axis l, is adjustable by means of the pivot provided by the yoke 40, and may be releasably secured by means of a fixing element, such as a nut 42 engaged to bolts projecting from the housing of the light 50, at any desired angle of the light 50 to prevent further rotation at the pivot point.

The yoke 40 is further provided with a releasable clamp 30, such as a C-clamp having a clamp arm 32 and fixing element, for example a bolt 34, threadedly engaged through the clamp arm 32.

The light 50 may be provided with additional, optional accessories 60, such as a filter or colour changer, which are typically mounted on the front of the light 50 and may be exchanged for other accessories, adjusted, or removed as necessary. Any accessory 60 adds weight to the front of the light 50.

Mounting of the light 50 onto the mounting base 10 is easily accomplished by applying the clamp 30 provided on the yoke 40 to the crosspiece 20 of the base 10, and adjusting the fixing element 34 to bear against the crosspiece 20 and lock the yoke 40 in position on the base 10. The plane y of the yoke 40 forms a mounting angle ϕ from the horizontal, as shown in FIG. 2.

Once the light 50 with optional accessories 60 is mounted on the base 10, the angles θ and ϕ can be adjusted so that light from the light 50 is directed at the intended target, while the center of gravity of the assembled light 50 and accessory 60 is positioned substantially over the crosspiece 20, so that the mounting system 100 as a whole is stabilized. The angle θ is adjusted by releasing the screw nut 42 fixing the angle θ between the yoke 40 and the light 50, if necessary, pivoting the light 50, and tightening the screw nut 42. The angle ϕ is adjusted by loosening the clamp 30, pivoting the clamp 30 around the cylindrical crosspiece 20, and fastening the clamp 30 in the desired position.

The direction of the light beam from the light 50 may be adjusted by altering the orientation of the light 50 with respect to the yoke 40 (angle θ) as well as by altering the mounting angle ϕ. These two angles preferably should also be adjusted as necessary to ensure that the centre of gravity of the light 50 (and any optional accessories 60) is located above the crosspiece 20 in order to maximize the stability of the mounted light assembly. By altering the angles θ and ϕ, it is possible to direct the light from the light 50 easily over a range of about 150° while maintaining the mounted light assembly in a stable orientation.

Optionally the mounting base 10 may be fixed to a support such as a floor, platform or truss by means of bolts fastened to the support through the bore holes 19, in which case the location of the centre of gravity of the assembled light 50 and the accessory 60 directly above the base 10 may be less important. By providing the bore holes in the flanges, the mounting base 10 thus acts as an adaptor plate for use on a truss for mounting the light 50.

Figure 3:
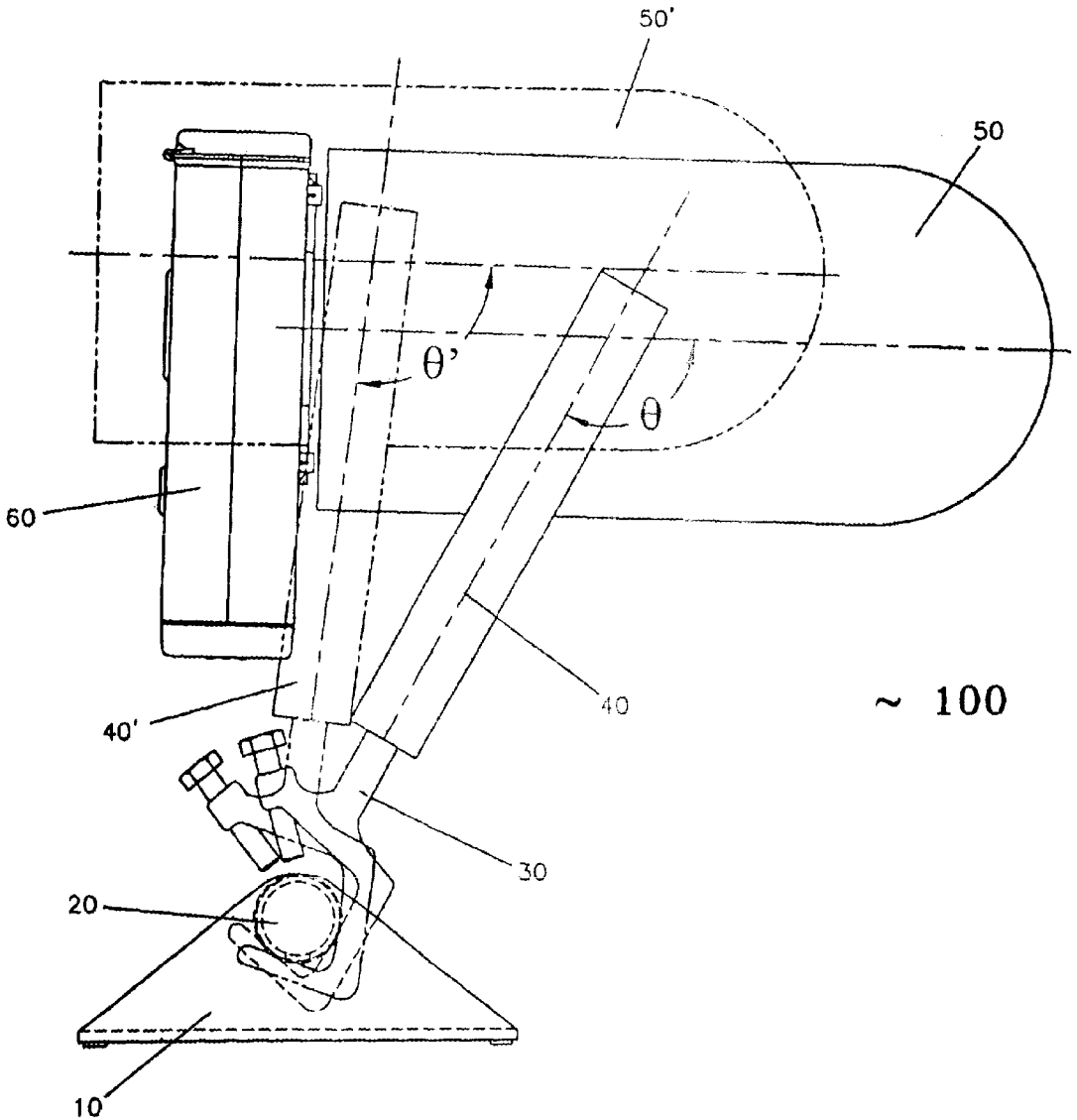
FIG. 3 is a side elevation of the mounting system of FIG. 2 showing the light repositioned to accommodate a change in the center of gravity arising from removal of the accessory.

The addition of a fixture 60 to the light 50 adds weight to the front of the light 50 such that the centre of gravity of the light/fixture assembly is shifted towards the front end of the light 50. If an accessory 60 is removed from the light, the centre of gravity of the light 50 will be shifted towards the back of the light 50. The light 50 is articulated to the base 10 by yoke 40, so that if an accessory 60 is removed from or added to the light 50 while it is mounted to the mounting system 100, the angles θ and ϕ may be adjusted as necessary to realign the centre of gravity of the light 50 above the base 10, as can be seen in FIG. 3 in phantom lines in which the accessory 60 shown in FIG. 2 has been removed from light 50'. Similarly, the mounting system 100 may be adjusted to accommodate changes to an accessory 60 mounted on the light 50. For example, adjustment to the focus of a telephoto lens may result in the extension or retraction of the lens over 25 centimeters or more, which could result in a significant change in the centre of gravity of the system. Again, angles θ and ϕ may be adjusted as necessary to realign the centre of gravity of the light 50 above the base 10.

Thus, in FIG. 3 the phantom angle θ' between the yoke 40' and the light 50' is smaller than the angle θ between the yoke 40 and the light 50. The angle ϕ has also been altered, with the effect that the centre of gravity of the light 50' is still disposed above the base 10 while the direction of the light 50' remains unchanged.

Various embodiments of the present invention having been thus described in detail by way of example, it will be apparent to those skilled in the art that variations and modifications may be made without departing from the invention. The invention includes all such variations and modifications as fall within the scope of the appended claims.

I claim:

1. An adjustable mounting system for a directional light, comprising:

a yoke having a first end for pivotably engaging the light at a first adjustable pivot, and a second end providing a releasable clamp, a base comprising a support comprising first and second pedestals, supporting a crosspiece for fastening the clamp to the base at a second adjustable pivot, a first fixing element for fixing the first adjustable pivot, and a second fixing element for fixing the second adjustable pivot, wherein the first and second adjustable pivots are independently adjustable to adjust a direction of the light and a position of the light relative to the base.

2. The adjustable mounting system of claim 1 wherein the crosspiece is cylindrical.

3. The adjustable mounting system of claim 1 wherein the first fixing element comprises a nut engaged to a bolt projecting from a housing of the directional light.

4. The adjustable mounting system of claim 1 wherein the second fixing element comprises a releasable clamp.

5. The adjustable mounting system of claim 2 wherein the first fixing element comprises a nut engaged to a bolt projecting from a housing of the directional light and the second fixing element comprises a releasable clamp.

6. The adjustable mounting system of claim 3 wherein the support comprises first and second pedestals.

7. The adjustable mounting system of claim 5 wherein the support comprises first and second pedestals.

8. The adjustable mounting system of claim 5 wherein the crosspiece is fixed between inside surfaces of the first and second pedestals.

9. The adjustable mounting system of claim 8 wherein at least one pedestal is provided with a bottom flange comprising bore holes for use in fastening the base to a floor, truss, or platform.

10. A base for mounting a directional light in combination with a yoke having a first end for pivotably engaging the light at a first adjustable pivot and provided with a first fixing element for fixing the first adjustable pivot, and a second end providing a releasable clamp and a second fixing element, the base comprising a support supporting a crosspiece for fastening the clamp to the base at a second adjustable pivot, wherein the second adjustable pivot is fixable with the second fixing element and the first and second adjustable pivots are independently adjustable to adjust a direction of the light and a position of the light relative to the base.

11. The base of claim 10 wherein the first fixing element comprises a nut engaged to a bolt projecting from a housing of the directional light and the second fixing element comprises a releasable clamp.

12. The base of claim 10 wherein the crosspiece is cylindrical.

13. A base for mounting a directional light pivotably engaged to a yoke at a lint adjustable pivot, the yoke being provided with a releasable clamp, the base comprising a support supporting a crosspiece for fastening the clamp to the base at an adjustable pivot, the crosspiece being fixed between inside surfaces of the first and second pedestals.

14. The base of claim 13 wherein the crosspiece is cylindrical.

15. The base of claim 14 wherein the support comprises a first and a second pedestal.

16. The base of claim 15 wherein at least one pedestal is provided with a bottom flange comprising bore holes for use in fastening the base to a floor, truss, or platform.

* * * * *